US007168948B2

(12) United States Patent
Swearingen et al.

(10) Patent No.: US 7,168,948 B2
(45) Date of Patent: Jan. 30, 2007

(54) HINGED ATTACHMENT TO A SPINNING CANDLE TOPPER

(75) Inventors: James Richard Swearingen, Newport, KY (US); Tom Clark, Long Grove, IL (US)

(73) Assignee: Soy Basics LLC, New Hampton, IA (US)

( * ) Notice: Subject to any disclaimer, the term of this patent is extended or adjusted under 35 U.S.C. 154(b) by 0 days.

(21) Appl. No.: 10/860,988

(22) Filed: Jun. 4, 2004

(65) Prior Publication Data

US 2004/0265760 A1 Dec. 30, 2004

Related U.S. Application Data

(60) Provisional application No. 60/480,944, filed on Jun. 24, 2003.

(51) Int. Cl.
*F21V 35/00* (2006.01)

(52) U.S. Cl. ..... 431/126; 431/291; 362/161

(58) Field of Classification Search ..... 431/126, 431/288, 289, 291, 310; 362/35, 161, 163, 362/172, 177, 180, 181, 182, 232, 806; 40/412, 40/417, 422, 441; 446/210, 397
See application file for complete search history.

(56) References Cited

U.S. PATENT DOCUMENTS

| | | | | |
|---|---|---|---|---|
| 102,995 | A | | 5/1870 | Wehrhan |
| 136,744 | A | | 3/1873 | May |
| 137,406 | A | | 4/1873 | Belknap |
| 154,285 | A | | 8/1874 | Schultze |
| 169,020 | A | | 10/1875 | Michaels |
| 290,489 | A | | 12/1883 | Simpson |
| 352,646 | A | | 11/1886 | Gennert |
| 380,293 | A | | 3/1888 | Lyth |
| 380,506 | A | | 4/1888 | Mehl et al. |
| 397,011 | A | | 1/1889 | Leynen-Hougaerts |
| 555,135 | A | | 2/1896 | Walsh et al. |
| 563,077 | A | | 6/1896 | Senge |
| 589,173 | A | | 8/1897 | Henke |
| 842,351 | A | | 1/1907 | Stock |
| 902,597 | A | | 11/1908 | Noe, Jr. |
| 938,031 | A | | 10/1909 | White et al. |
| 1,140,092 | A | | 5/1915 | Yamamoto |
| 1,178,764 | A | | 4/1916 | Watanabe |
| 1,338,611 | A | | 4/1920 | Browne |
| 1,421,161 | A | | 6/1922 | Browne |
| 1,437,194 | A | | 11/1922 | Raff |
| 1,555,481 | A | | 9/1925 | Olsson |
| 1,559,327 | A | * | 10/1925 | Hisashi et al. ..... 446/210 |
| 1,653,256 | A | | 12/1927 | Davis |
| 1,975,496 | A | | 10/1934 | Barrett, Jr. |
| 2,028,662 | A | | 1/1936 | Hansman |
| 2,254,664 | A | | 9/1941 | Quinlan |
| 2,579,725 | A | | 12/1951 | Burnbaum |
| 2,600,664 | A | | 6/1952 | Leech |
| D170,461 | S | | 9/1953 | Heinzel |
| 4,185,953 | A | | 1/1980 | Schirneker |

(Continued)

*Primary Examiner*—Jiping Lu
(74) *Attorney, Agent, or Firm*—Frost Brown Todd LLC

(57) ABSTRACT

A candle topper fits onto containerized candles, such as scented candles within a cylindrical apothecary jar, not only serving to enhance efficient combustion and add a decorative finish thereto, but also directing exhaust gases as a convective motive force to spin a fan. Thereby, hanging ornaments enhance the entertaining value of the candle topper.

7 Claims, 9 Drawing Sheets

U.S. PATENT DOCUMENTS

| | | | |
|---|---|---|---|
| 4,384,847 | A | 5/1983 | Schirneker |
| D274,367 | S | 6/1984 | Anderson |
| D280,608 | S | 9/1985 | Boberg |
| D330,345 | S | 10/1992 | Elméer |
| 5,860,725 | A | 1/1999 | Zer et al. |
| D410,558 | S | 6/1999 | Yu |
| 6,135,603 | A | 10/2000 | Chen |
| 6,231,336 | B1 | 5/2001 | Chen |
| 6,382,962 | B1 | 5/2002 | Papai |
| D462,132 | S | 8/2002 | Papai |
| D465,587 | S | 11/2002 | Papai |
| D466,236 | S | 11/2002 | Papai |
| D471,299 | S | 3/2003 | Papai |
| D473,330 | S | 4/2003 | Papai |
| 6,572,428 | B1 * | 6/2003 | Weiser et al. ..... 40/417 |
| 6,585,510 | B2 | 7/2003 | Papai |
| 6,589,047 | B1 | 7/2003 | Papai |
| 6,663,384 | B2 | 12/2003 | Papai |
| 6,783,356 | B2 | 8/2004 | Hermanson |
| 2003/0106248 | A1 | 6/2003 | Chang |
| 2003/0129558 | A1 | 7/2003 | Papai |
| 2003/0230013 | A1 | 12/2003 | Chang |

* cited by examiner

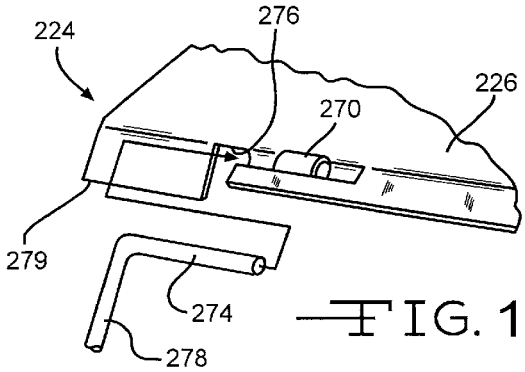
FIG. 11
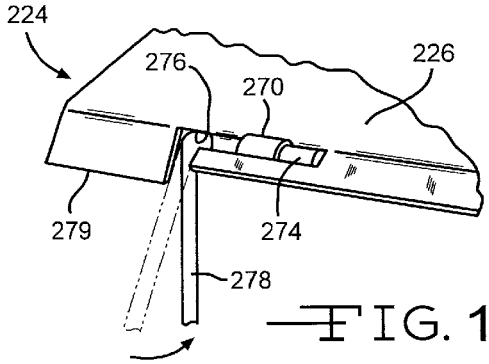
FIG. 12
FIG. 9
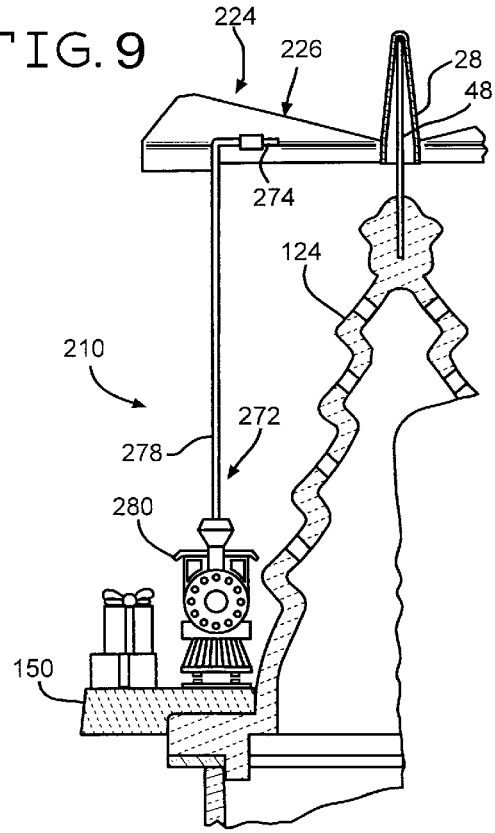

HINGED ATTACHMENT TO A SPINNING CANDLE TOPPER

CROSS REFERENCE TO RELATED APPLICATIONS

The present application hereby claims the benefit of the provisional patent application entitled CANDLE TOPPER, Ser. No. 60/480,944, filed on Jun. 24, 2003.

FIELD OF THE INVENTION

The present invention relates, in general, to devices that decorate containerized candles, and especially those utilizing convective air current therefrom as a motive force.

BACKGROUND OF THE INVENTION

Containerized candles have long been used as a source of light. Recently, scented candles in apothecary jars or similarly shaped vessels have become widely used. Due to restrictions imposed by the jar, these containerized candles tend to accumulate soot from combustion inefficiencies. In addition, the candle is made from a combination of paraffin wax and scented oils that also have a tendency to create smoke. Recently, various lids for candle apothecary jars have been widely used that include a central exhaust aperture surrounded by intake openings for the purpose of optimizing combustion to prevent soot formation. In U.S. Pat. No. 6,231,336, a rotating cover plate allows for adjustments in the amount of air drawn into the candle to further control the temperature inside the candle apothecary jar. In U.S. Pat. No. 6,382,962, various dimensions are taught for an exhaust vent and a plurality of inlet vents to assist in creating laminar airflow and thus enhanced combustion.

In addition, such vent plates have been used to enhance the aesthetics of apothecary jar candles, such as described in U.S. Design Pat. Nos. D471,299; D466,236; D462,132; D465,587 and D473,330 wherein the shape of the apertures is decorative. In U.S. Pat. Appln. Pub. No. 2003/0129558 A1, more economical and decorative molded poly resin reliefs overlay the venting plate with certain attachment features provided to avoid excess heat being transferred from the venting plate base.

As an alternative, in U.S. Pat. Nos. 6,589,047; 6,585,510 and 6,663,384, feet along an under surface of a venting plate lift up the venting plate to form inlets for air to enter a candle apothecary jar, with air exhausting up through the center of the venting plate. In part, this approach reduces the thermal conduction from the jar to the candle topper to protect ornamentation thereon. Significantly, also taught is an annular baffle that is generally believed to be necessary or at least advantageous to direct incoming air downward toward the wick to maintain laminar flow. These developments have allowed increasingly more decorative use of apothecary jar candles without discoloration due to overheating of the decoration or due to soot from inefficient combustion.

For a long time, another approach to creating entertainment and decoration from a light source is to use the motive force of the air flow generated thereby to rotate an object. In U.S. Pat. No. 1,140,092, an open candle or light bulb rotates a lamp shape. In U.S. Pat. No. 5,860,725, a similar lamp shade rotation is described. In U.S. Pat. No. 4,185,953, a floating carrier wick for use with liquid fuel includes a bladed rotor to cause rotation. It is also known to rotate a decorative object, such as described in U.S. Pat. Nos. 154,285; 290,489; 352,646; 563,077; 589,173; 842,351; D274,367; D280,608; 6,135,603; and D330,345. However, in each instance, these generally known spinning decorations are driven by an open heat source that is unencumbered by a container.

While these spinning devices have long been well received, it would be desirable to incorporate advantages of apothecary jar candles that avoid a mess of dripped wax, and reduce the likelihood of damage or injury due to contact with the open flame of an exposed candle. Yet, the tendency for such apothecary jar candles to burn inefficiently may discourage their use as a convective motive force.

Consequently, a significant need exists for a spinning decorative device that is adapted for use with an apothecary jar candle.

BRIEF SUMMARY OF THE INVENTION

The invention overcomes the above-noted and other deficiencies of the prior art by providing a base that is positioned upon a containerized candle and that directs exhaust air therefrom onto a fan to rotate decorations attached thereto. We discovered that the base causes sufficient convective motive force to be generated from the containerized candle such that spinning decorations are possible, enhancing the decorative possibilities without losing the convenience.

In one aspect of the invention, a device is useful for decorating a containerized candle that has a vessel with a brim containing a fuel burnt at a wick positioned below an opening defined by the brim. A base is sized to overlay the opening of the vessel. Defined in the base is an exhaust aperture registered to overlay the wick. A spindle attached to the base and having an axle mechanism positioned above the exhaust aperture allows a fan, which is rotatingly coupled to the axle mechanism, to be spun by the exhaust gases from the wick (i.e., convective motive force).

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

FIG. 9 is a side view in cross section of a left portion of a candle toper having annularly pivoting ornament attachments integral to a fan.

FIG. 11 is a detail view of a pivoting end of a hanging ornament detached from the ornament attachment of the fan of FIG. 9.

FIG. 12 is a detail view of the hanging ornament attached to the fan of FIG. 9.

DETAILED DESCRIPTION OF THE INVENTION

Turning to the drawings, wherein like numerals denote like components throughout the several views, in FIGS. 1–6, a candle topper 1, consistent with the present invention, entertains and decorates a containerized candle 12 by converting heated exhaust gases therefrom into a rotational motion.

Figure 1:
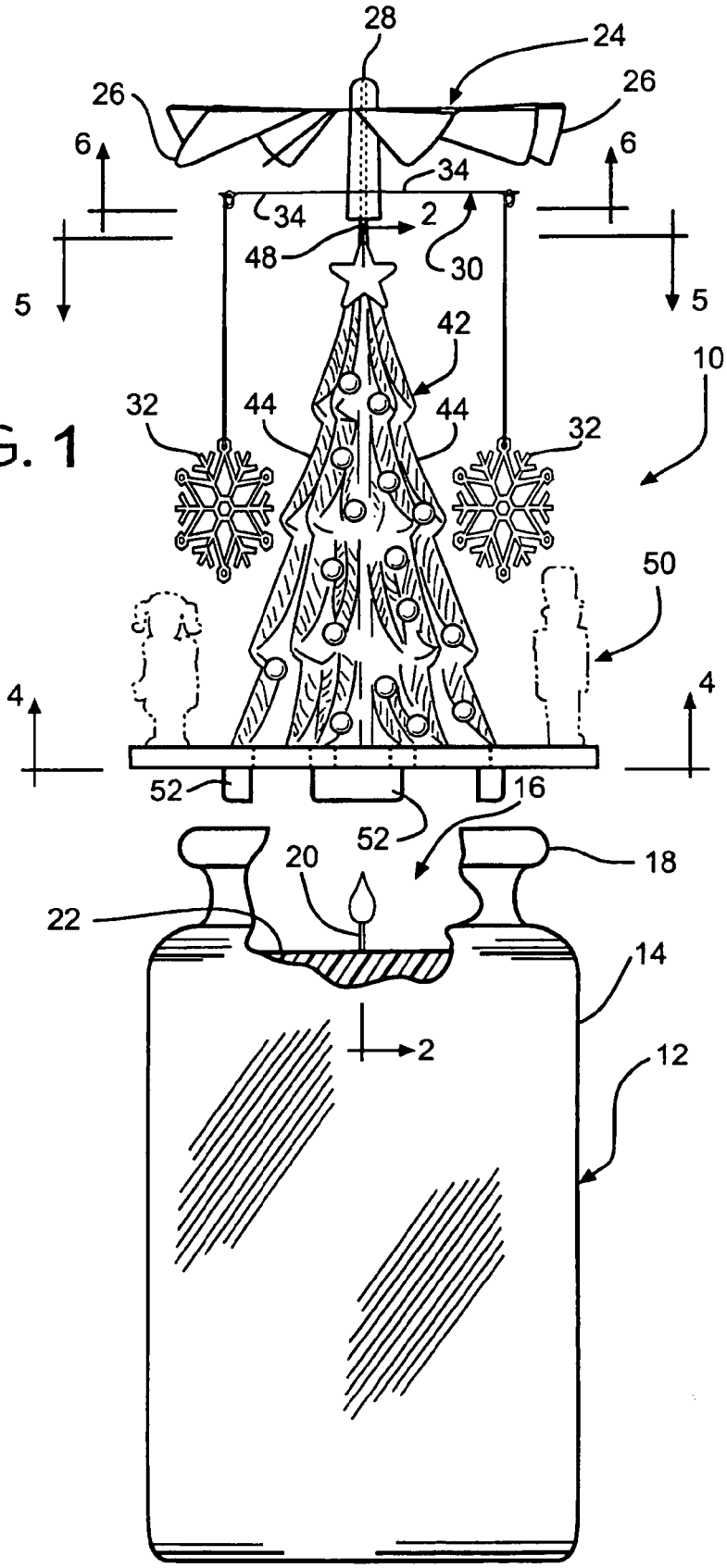
FIG. 1 is a side view in elevation of a candle topper consistent with aspects of the present invention shown disassembled from a containerized candle, which is shown partially cut away.
Figure 2:
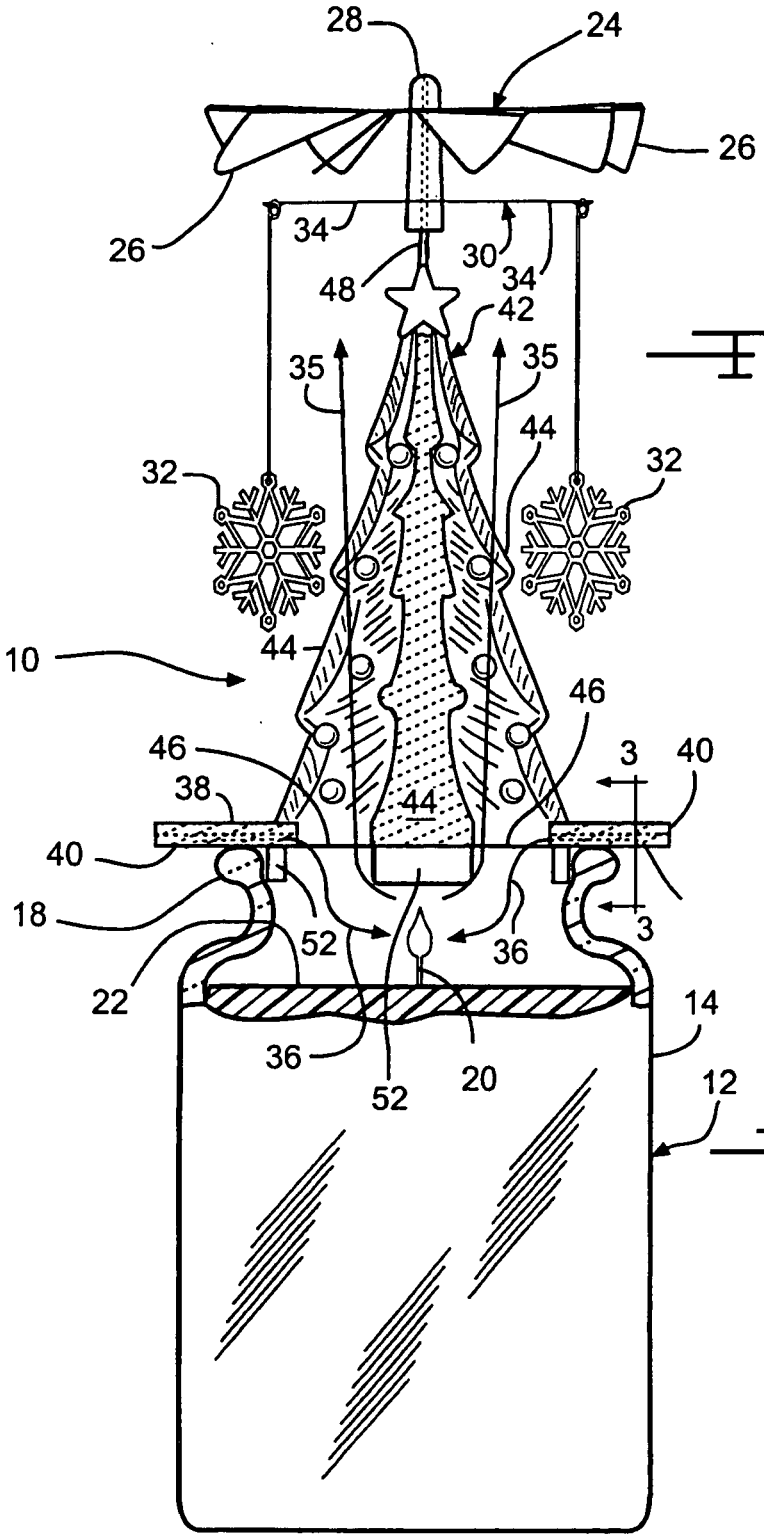
FIG. 2 is a side view in cross section taken along line 2—2 of the candle topper assembled onto the containerized candle of FIG. 1 illustrating air flow therethrough to rotate a fan.

With particular reference to FIGS. 1 and 2, while a candle topper 10 may be sized to accommodate many different styles of vessels, in an illustrative version, the containerized candle 12 has a cylindrical apothecary jar 14 having an opening 16 at its top defined by a brim 18. Intake air enters through the opening 16 to a burning wick 20 whereat fuel 22 (e.g., paraffin, vegetable-oil based wax, lamp oil) is burned.

Figure 6:
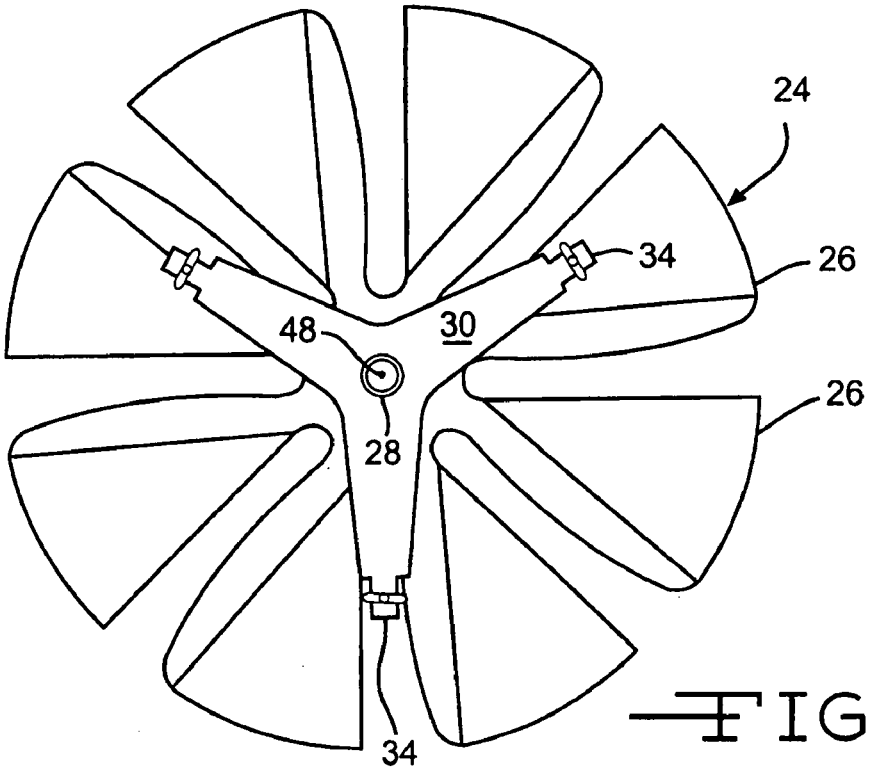
FIG. 6 is a bottom view taken in cross section along line 6—6 of an ornament attachment and fan of the candle topper of FIG. 1.

With particular reference to FIGS. 1, 2 and 6, exhaust gases from the wick 20 create a vertically directed convective motive force that impinges upon a horizontal fan 24, which is comprised of a plurality of fan blades 26 centrally attached to a fan hub 28. Extending horizontally from the fan hub 28 below the fan blades 26 is a support plate 30 from which a plurality of hanging ornaments 32 (FIGS. 1 and 2) are attached. In FIG. 6, the support plate 30 includes a plurality of support arms 34 that minimize deflection of the rising exhaust gases, depicted as arrows 35 in FIG. 2, away from the fan blades 26.

Figure 3:
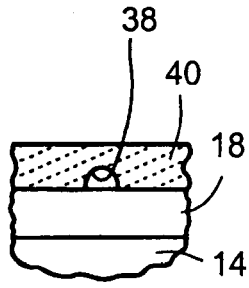
FIG. 3 is a side view in cross section taken along line 3—3 through an annular portion of a base of the candle toper of FIG. 1 illustrating a horizontal intake passage defined therein.
Figure 4:
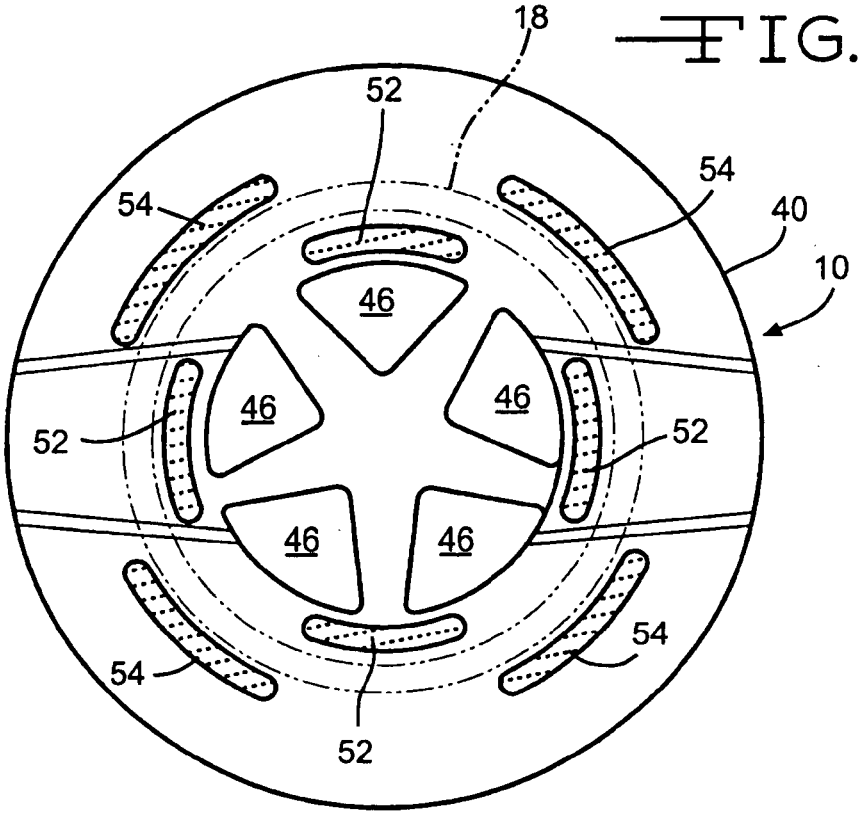
FIG. 4 is a bottom view taken along line 4—4 of the candle topper of FIG. 1.

With reference to FIGS. 2–4, one way in which intake air, depicted as arrows 36 in FIG. 2, may enter the opening 16 of the jar 14 is for inlet passages 38 to be integrally formed into a base 40 of the candle topper 10. Alternatively, it should be appreciated that intake openings are spaced around the top of the base 40. Below, a further alternative whereby intake air is allowed to enter under the base 40 will be described.

With reference to FIGS. 1–5, a fan support 42 is depicted as vertical triangles 44 joined along a vertical central axis of the base 40 to which they are attached. Exhaust apertures 46 are formed in the base 40 within the spaces defined between the vertical triangles 44. The fan support 42 terminates at its apex in a spindle 48 that is received within the fan hub 28 to form a low friction rotation point, or axle mechanism 49, for the fan 24.

Figure 5:
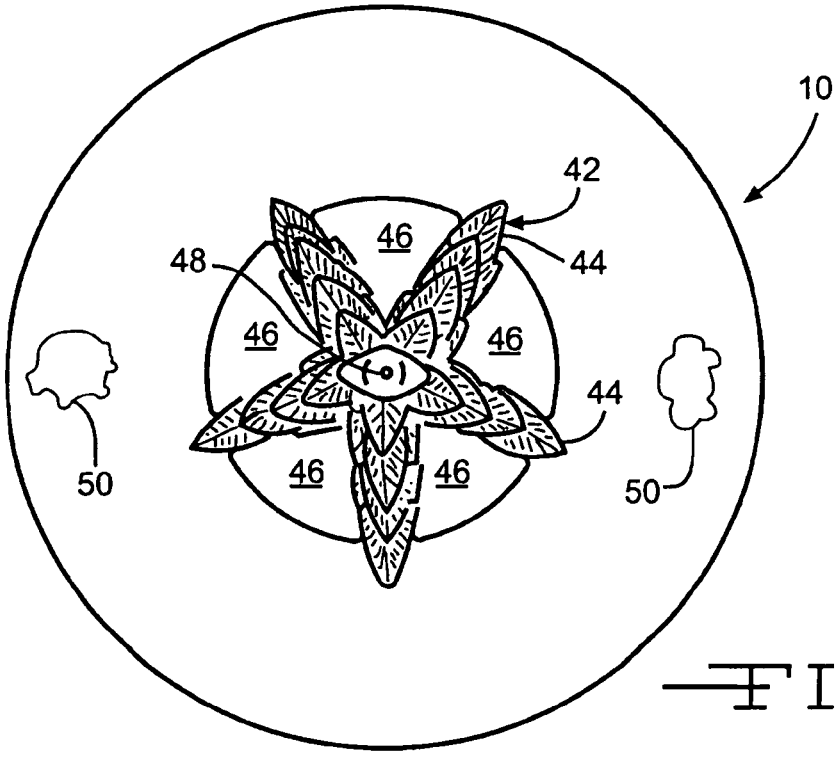
FIG. 5 is a top view taken in cross section along line 5—5 of the candle topper of FIG. 1.

In FIGS. 1 and 5, the base 40 is also shown as supporting fixed ornaments 50 that are spaced away from the hanging ornaments 32. In FIGS. 1, 2 and 4, the base 40 also includes an inner plurality of downwardly projecting, concentric segmented circular ridges ("inner ridges") 52 registered to within the brim 18 of the jar 14 for stabilizing the candle topper 10. In FIG. 4, an outer plurality of downwardly projecting, concentric segmented circular ridges ("outer ridges") 54 are shown to register to the outside of the brim 18 as an alternative or an addition to the inner ridges 52.

Figure 8:
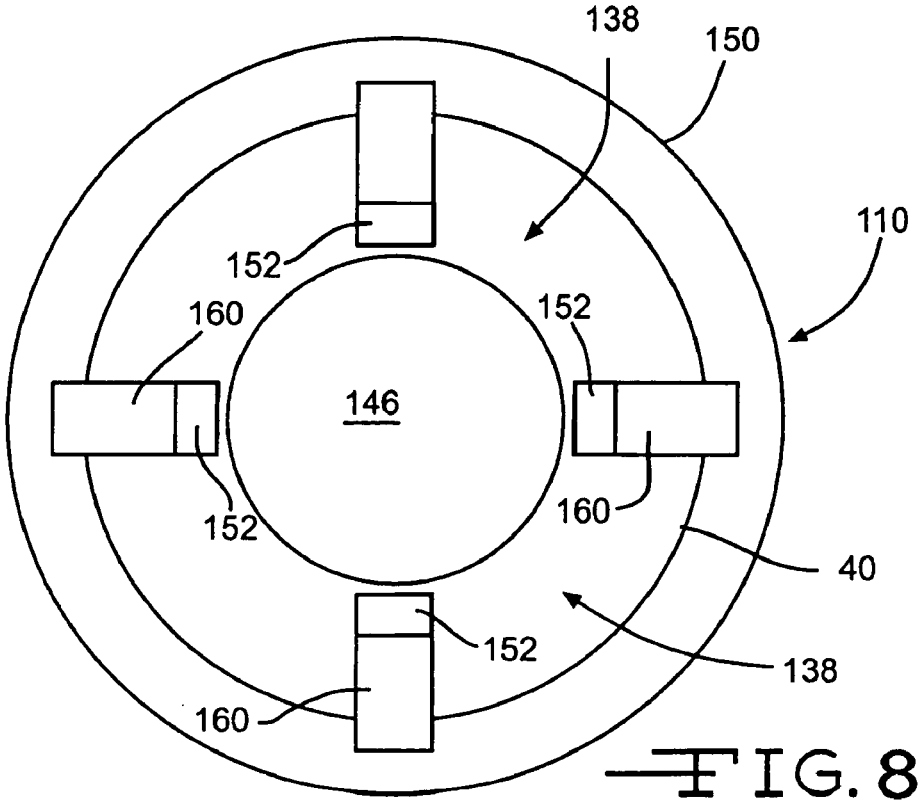
FIG. 8 is a bottom view taken along line 8—8 of the candle topper of FIG. 7.
Figure 7:
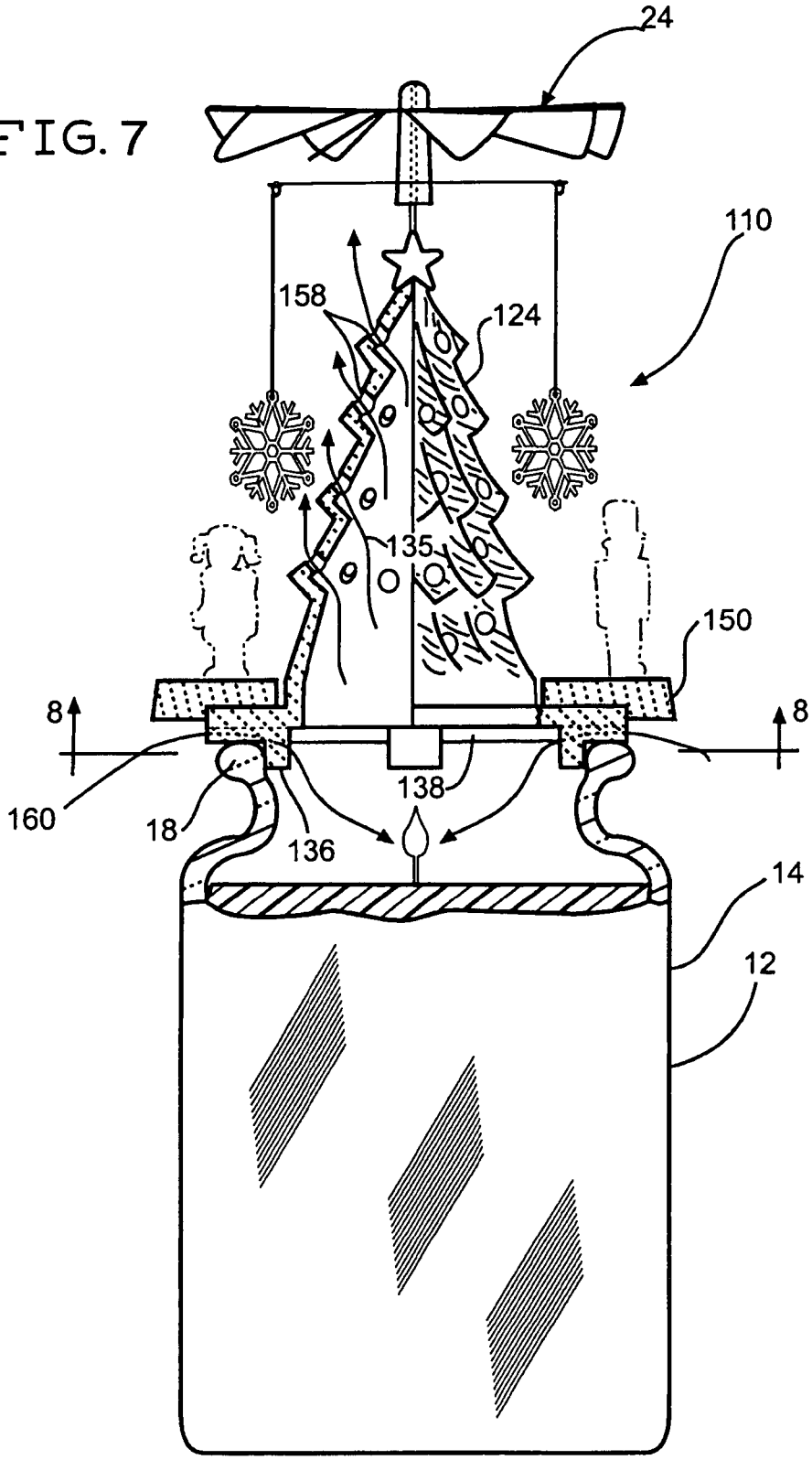
FIG. 7 is a side view in elevation of a candle topper having a hollow chimney portion with a plurality of exhaust orifices and having contact surfaces that center and raise a base defining intake apertures with the jar.
Figure 10:
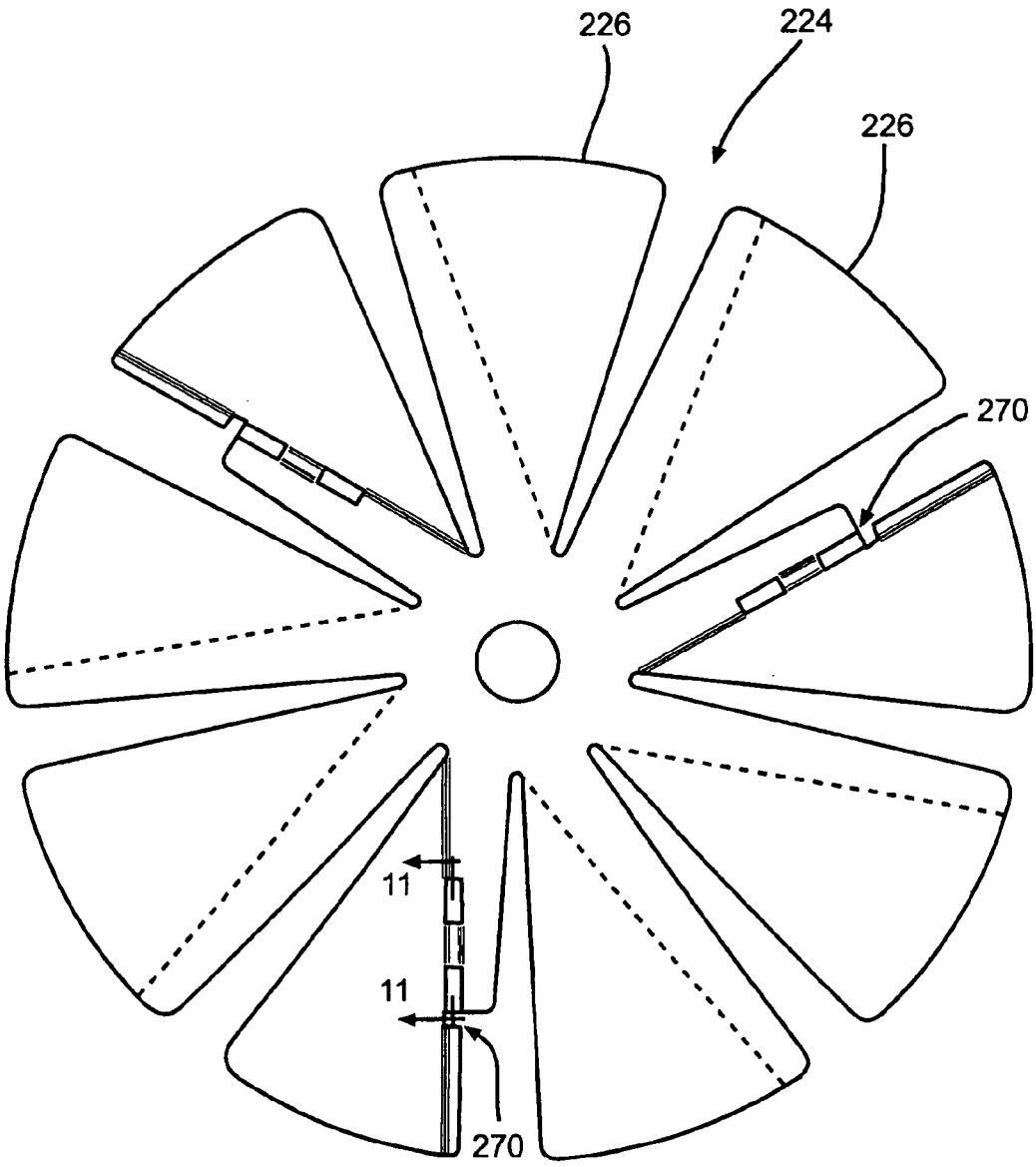
FIG. 10 is a top view of the fan of the candle topper of FIG. 9.

In FIGS. 7 and 8, a candle topper 110 is similar to that described above with several exceptions. First, a hollow fan support 124 has a hollow chimney opening at its bottom at a central exhaust aperture 146. A plurality of exit ports 158 allow exhaust gases, depicted by arrows 135 (FIG. 7) to exit the hollow fan support 124 toward the fan 24. Such a hollow fan support 124 may be used to allow for the fan 24 to be vertically raised while providing sufficient convective motive force for rotation. Second, the base 40 and hollow fan support 124 are advantageously formed from a heat resistant material, such as ceramic. Fixed ornamentation 150 may be economically and decoratively formed from a poly resin material in a ring-like shape that circumferencially rests upon the base 40. Third, one of a plurality of inner ridges 152 extend downward from an inward portion of a respective spacer 160 to stabilize the candle topper 110. Insofar as inlet air, depicted as arrows 136 in FIG. 7, is not able to enter the opening 16 at each spacer 160 and inner ridge 152 combination, the combination presents a narrow profile as compared to each inlet aperture 138 defined between adjacent spacers 160, base 40 and brim 18.

In FIGS. 9–12, another candle topper 210 is shown that is similar to that described above for FIGS. 7 and 8 with an exception in an advantageous attachment approach for rotating ornamentation. In particular, a support plate is omitted by instead incorporating a fan 224 wherein some of its constituent fan blades 226 include a hanging ornament attachment fixture, depicted as a radially-aligned pin guide 270. Each hanging ornament 272 terminates at its apex in a horizontal pin 274 that is inserted into the pin guide 270. With particular reference to FIGS. 11 and 12, a locking cutout 276 formed into the fan blade 226 adjacent to the pin guide 270 receives a rigid vertical shaft 278 of the hanging ornament 272 after the horizontal pin 274 is inserted into the pin guide 270, preventing inadvertent disengagement of the hanging ornament 272. In particular, the locking cut-out 276 is positioned to allow insertion of the horizontal pin 274 with vertical shaft 278 is rotated to a substantially horizontal position and comprising a blocking structure 279 positioned to extend from the fan blade 226 promximate to the vertical shaft 278 when the vertical shaft 278 is rotated to a substanially vertical position, typically by gravity, thereby blocking retraction of the horizontal pin 274. Not only does this eliminate parts count and assembly time for the candle topper 210, but also the movement of the hanging ornament 272 may be limited in this instance. In particular, a rotating decorative object, depicted as a toy train 280, attached to the rigid vertical shaft 278 will rotate around the hollow fan support 124 within a fixed circle, resisting centripetal force. Thus, fixed ornaments such as depicted gift boxes 282 are not damaged and uninterrupted rotation is maintained.

Figure 13:
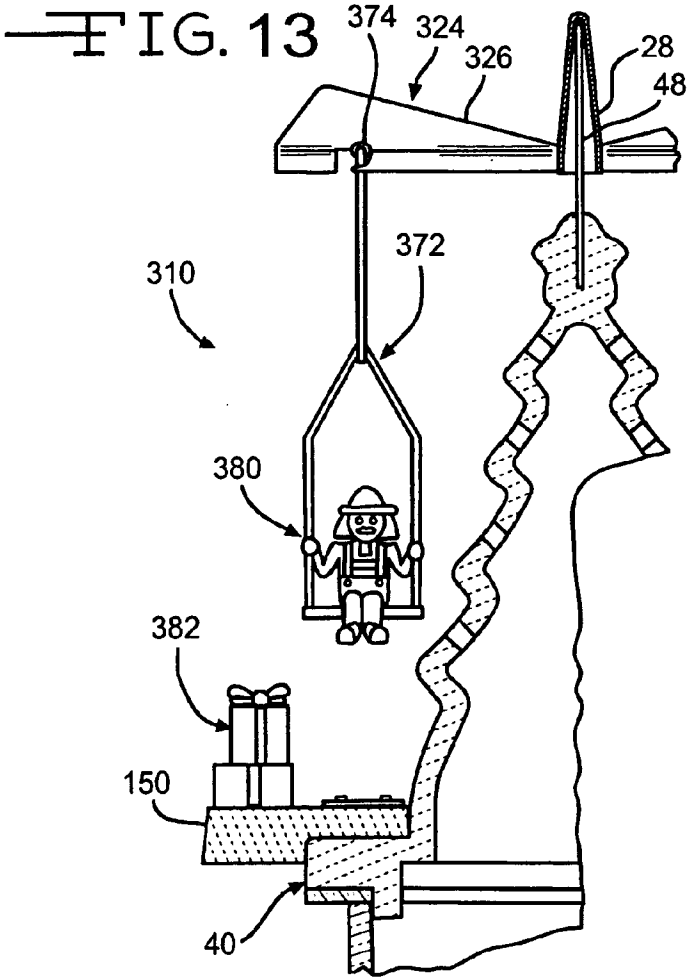
FIG. 13 is a side view in cross section of a left portion of a candle topper having outwardly pivoting ornament attachments integral to a fan.
Figure 14:
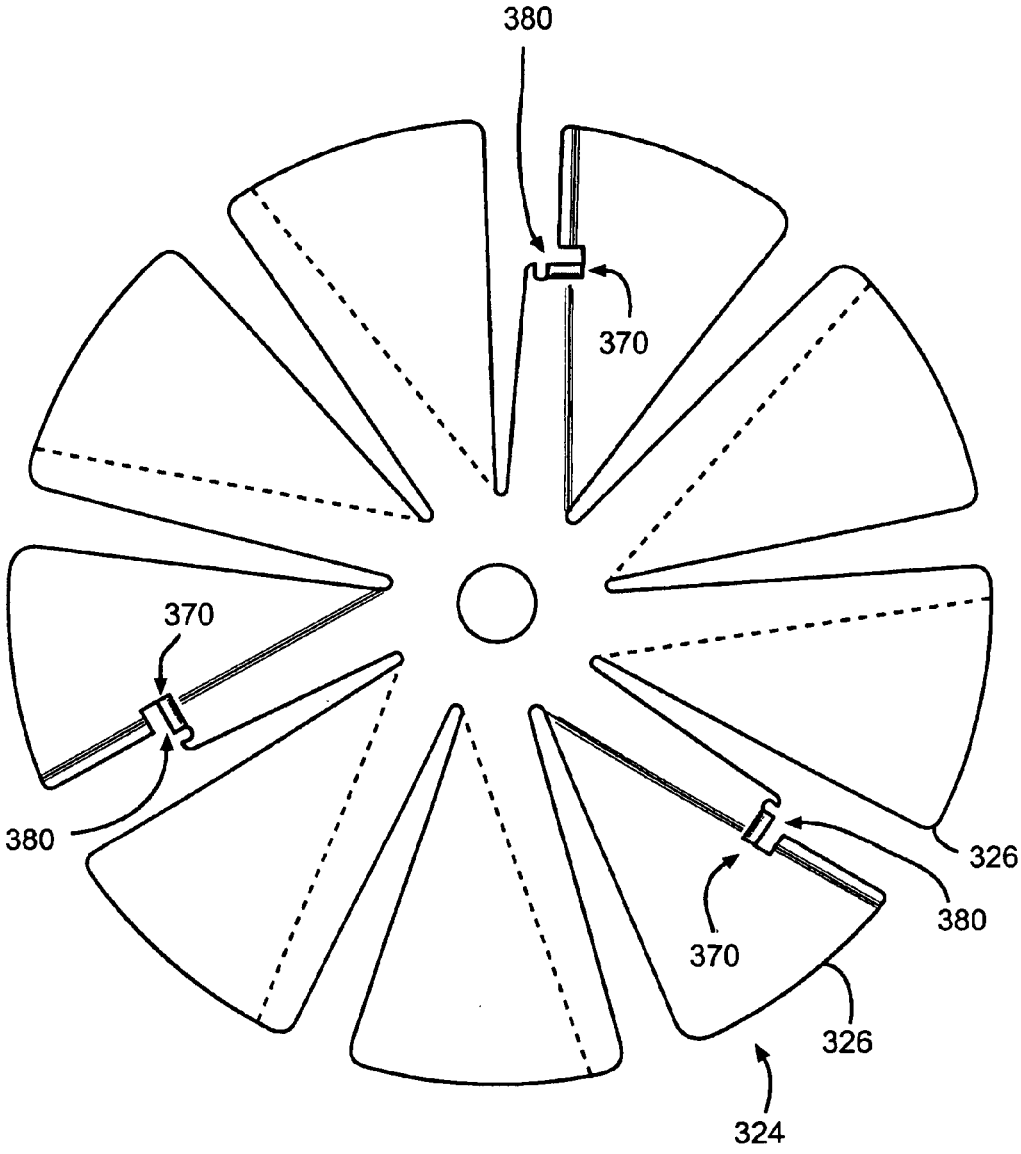
FIG. 14 is a top view of a fan having outwardly pivoting ornament attachments integral to the fan of the candle topper of FIG. 13.

In FIGS. 13 and 14, yet another candle topper 310 is depicted that is similar to that described above for FIGS. 9–12 with the exception that concentric pin guides 370 are formed into respective fan blades 326 of a fan 324. Economic manufacture is again realized by being able to form fan 324 from sheet material and by forming a corresponding pin 374 on a hanging ornament 372 by bending its rigid vertical shaft 378 perpendicularly. Ease of assembly with prevention of inadvertent disengagement is provided by cutting apertures as an "L" shaped recess 384 on an outer side and counter clockwise side of the pin guide 370. Thereby, the hanging ornament 372 is allowed to rotate outwardly with increasing rotational speed, which in FIG. 13 allows a rotating decorative object, depicted as a child seated on a carnival swing 380, to more closely simulate the actual carnival ride.

Figure 15:
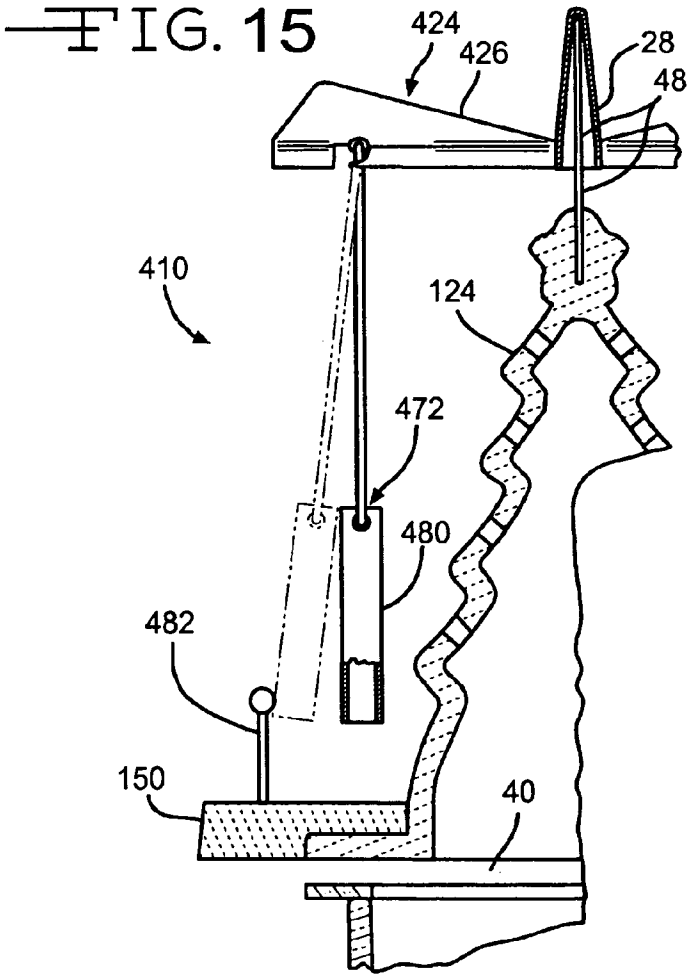
FIG. 15 is a side view in cross section of an alternate sound producing hanging ornament and striker for the candle topper of FIG. 13.

In FIG. 15, yet another candle topper 410 is depicted that is similar to that described above for FIGS. 13 and 14 with the exception that a fixed ornament, depicted as a striker 482 is positioned to contact a sound producing object of a hanging ornament 472, depicted as a metal chime 480, as the latter swings outwardly with increased rotational speed.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art. For example, although hanging ornaments have been illustrated here, applications consistent with aspects of the invention may include ornaments that extend upwardly from a fan, either central thereto or a plurality spaced annularly.

As another example, although a centrally positioned single wick has been illustrated for clarity and for general applicability, some applications, consistent with aspects of the invention, may include a chassis of sufficient size to overlay a candle having multiple wicks, with an exhaust aperture defined in the chassis either sufficiently large to register to all of the wicks or being multiple exhaust apertures.

As yet a further example, while a centered spindle is shown for clarity, one or more fans may be positioned offset to an exhaust aperture. In addition, a fan my be positioned with its axis of rotation being horizontal, having one lateral portion exposed to exhaust gases, with perhaps the other lateral portion exposed to intake air to further enhance its motive force.

In yet an additional example, while a spindle within a fan hub performs as an axle mechanism, especially when the hanging ornaments are well balanced about the fan hub, applications consistent with the present invention may include other axle mechanisms, including those capable of supporting an unbalanced load.

In yet a further example, It should be appreciated that in some instances a containerized candle may be substituted with other sources of a convective motive force, such as by an incandescent light bulb, for example in locations where a flame is not appropriate or desirable.

What is claimed is:

1. A decorated containerized candle, comprising:

a vessel comprising a brim containing a fuel burnt at a wick positioned below an opening defined by the brim; and a device comprising:

a base sized to overlay the opening of the vessel, an exhaust aperture defined in the base registered to overlay the wick, a spindle attached to the base and having an axle mechanism positioned above the exhaust aperture, a fan rotatingly coupled to the axle mechanism comprising a plurality of fan blades, a radially aligned pin guide formed in a selected one of the fan blades, and a hanging ornament comprising a bent support comprising a horizontal pin recived in the pin guide and a vertical shaft attached to said horizontal pin allowed to tangentially swing about the pin guide.

2. The device of claim 1, wherein the pin guide includes a locking cut-out positioned to allow insertion of the horizontal pin with the vertical shaft rotated to a substantially horizontal position and comprising a blocking structure positioned to extend from the fan blade proximate to the vertical shaft when the vertical shaft is rotated to a substantially vertical position thereby blocking retraction of the horizontal pin.

3. The device of claim 1, wherein the hanging ornament comprises a sound producing chime, the device futher comprising a stiker projecting up from the base proximate to a rotational path of the at least one sound producing chime.

4. The device of claim 1, further comprising an intake passage formed integral to the base communicating air to the wick.

5. The device of claim 1, further comprising a plurality of spacers positioned to raise the base above the brim defining intake apertures therebetween.

6. The device of claim 1, further comprising a chimney attached to the exhaust aperture and operably configured to guide convective motive forces from the exhaust aperture to the fan.

7. The device of claim 6, wherein the chimney comprises a portion of the base to which the spindle is attached.

* * * * *